US009228323B2

(12) United States Patent
Kawasaki et al.

(10) Patent No.: US 9,228,323 B2
(45) Date of Patent: Jan. 5, 2016

(54) CONTROL SYSTEM FOR CONSTRUCTION MACHINE

(75) Inventors: Haruhiko Kawasaki, Atsugi (JP); Masahiro Egawa, Kawaguchi (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 536 days.

(21) Appl. No.: 13/577,510

(22) PCT Filed: Feb. 23, 2011

(86) PCT No.: PCT/JP2011/054003

§ 371 (c)(1),
(2), (4) Date: Aug. 7, 2012

(87) PCT Pub. No.: WO2011/105436

PCT Pub. Date: Sep. 1, 2011

(65) Prior Publication Data

US 2012/0304630 A1 Dec. 6, 2012

(30) Foreign Application Priority Data

Feb. 26, 2010 (JP) ..... 2010-042233

(51) Int. Cl.

| | |
|---|---|
| ***E02F 9/22*** | (2006.01) |
| ***F15B 11/17*** | (2006.01) |
| ***E02F 9/20*** | (2006.01) |

(52) U.S. Cl.

CPC ..... *E02F 9/2217* (2013.01); *E02F 9/2075* (2013.01); *E02F 9/2091* (2013.01); *E02F 9/2282* (2013.01); *E02F 9/2285* (2013.01); *E02F 9/2292* (2013.01); *E02F 9/2296* (2013.01); *F15B 11/17* (2013.01); *F15B 2211/20546* (2013.01);

(Continued)

(58) Field of Classification Search

None

See application file for complete search history.

(56) References Cited

U.S. PATENT DOCUMENTS 6,151,894 A * 11/2000 Endo et al. ..... 60/414
6,725,581 B2 * 4/2004 Naruse et al. ..... 37/348

(Continued)

FOREIGN PATENT DOCUMENTS

CN 101091025 A 12/2007
CN 101595313 12/2009

(Continued)

OTHER PUBLICATIONS

German Office Action with translation dated Apr. 22, 2015.

*Primary Examiner* — Nathaniel Wiehe
*Assistant Examiner* — Dustin T Nguyen
(74) *Attorney, Agent, or Firm* — Rabin & Berdo, P.C.

(57) ABSTRACT

A control system for construction machine includes a main pump; a circuit system which includes a plurality of operation valves; a boom cylinder which is connected to a specific valve; one passage which allows communication between the specific operation valve and a piston-side chamber; another passage which allows communication between the specific operation valve and a rod-side chamber; a hydraulic motor which rotates by the action of return oil from the piston-side chamber; a generator; and a valve mechanism which is provided in the one passage communicating with the piston-side chamber of the boom cylinder, introduces the return oil from the piston-side at the time of descent as a regeneration flow to the hydraulic motor and introduces the return oil as a recovery flow to the rod-side chamber if necessary by causing the return oil to flow into the other passage.

16 Claims, 3 Drawing Sheets

(52) U.S. Cl.
CPC *F15B 2211/20576* (2013.01); *F15B 2211/265* (2013.01); *F15B 2211/3116* (2013.01); *F15B 2211/88* (2013.01)

(56) References Cited

U.S. PATENT DOCUMENTS

| | | | | |
|---|---|---|---|---|
| 7,596,893 | B2 | 10/2009 | Tozawa et al. | |
| 8,539,762 | B2 * | 9/2013 | Shimada et al. | 60/431 |
| 2009/0036264 | A1 | 2/2009 | Tozawa et al. | |
| 2009/0288408 | A1 * | 11/2009 | Tozawa et al. | 60/435 |
| 2010/0089045 | A1 | 4/2010 | Shimada et al. | |

FOREIGN PATENT DOCUMENTS

| | | | | |
|---|---|---|---|---|
| DE | 4410976 | C2 | 9/2002 | |
| JP | 2006-336304 | A | 12/2006 | |
| JP | 2006-336432 | A | 12/2006 | |
| JP | 2006-336846 | A | 12/2006 | |
| JP | 2008-215528 | A | 9/2008 | |
| JP | WO2008/108013 | * | 9/2008 | F15B 11/024 |
| JP | 2009-127643 | A | 6/2009 | |
| JP | 2009-235717 | A | 10/2009 | |
| JP | 2009-235718 | | 10/2009 | |
| JP | 2009-236190 | A | 10/2009 | |
| JP | 2009-281525 | A | 12/2009 | |

* cited by examiner

CONTROL SYSTEM FOR CONSTRUCTION MACHINE

TECHNICAL FIELD

The present invention relates to a control system for construction machine in which return oil from a boom cylinder is used as a regeneration flow and a recovery flow.

BACKGROUND ART

JP2009-236190A discloses a hybrid construction machine in which a hydraulic motor is rotated utilizing return oil from a boom cylinder and a generator is rotated by a rotational force of the hydraulic motor. In this construction, a regeneration flow control valve is provided at a passage connecting a piston-side chamber of the boom cylinder and an operation valve and the regeneration flow control valve is connected to the hydraulic motor.

Further, a lowering speed of the boom cylinder is controlled while the regeneration flow is controlled by the regeneration flow control valve, and the flow of the return oil from the boom cylinder other than the regeneration flow is partly recycled to a rod-side chamber of the boom cylinder and returned to a tank via the operation valve.

SUMMARY OF THE INVENTION

Since, out of the regeneration flow and the recovery flow which are the return oil from the boom cylinder, the regeneration flow does not flow to the operation valve in the conventional hybrid construction machine, a sufficient recovery flow cannot be ensured. This creates a negative pressure in the rod-side chamber of the boom cylinder, thereby impairing a smooth operation and producing noise during the operation.

An object of the present invention is to provide a control system for construction machine which can ensure a sufficient recovery flow while controlling a lowering speed of a boom cylinder.

According to one aspect of the present invention, a control system for construction machine is provided which comprises a main pump; a circuit system which includes a plurality of operation valves connected to the main pump; a boom cylinder which is connected to a specific one of the plurality of operation valves; one passage which allows communication between the specific operation valve and a piston-side chamber of the boom cylinder; another passage which allows communication between the specific operation valve and a rod-side chamber of the boom cylinder; a hydraulic motor which rotates by the action of return oil from the piston-side chamber of the boom cylinder; a generator which generates power by a rotational force of the hydraulic motor; a battery which stores power generated by the generator; and a valve mechanism which is provided in the one passage communicating with the piston-side chamber of the boom cylinder, introduces the return oil from the piston-side chamber of the boom cylinder at the time of descent as a regeneration flow to the hydraulic motor and introduces the return oil as a recovery flow to the rod-side chamber of the boom cylinder if necessary by causing the return oil to flow into the other passage.

According to the above aspect, since the return oil from the boom cylinder can be supplied to the hydraulic motor and, if necessary, also to the rod-side chamber while a lowering speed of the boom cylinder is controlled, the hydraulic motor can be actuated without creating a negative pressure at the time of lowering the boom cylinder.

Embodiments of the present invention and advantages thereof are described in detail below with reference to the accompanying drawings.

DESCRIPTION OF EMBODIMENTS

A first embodiment is described.

Figure 1:
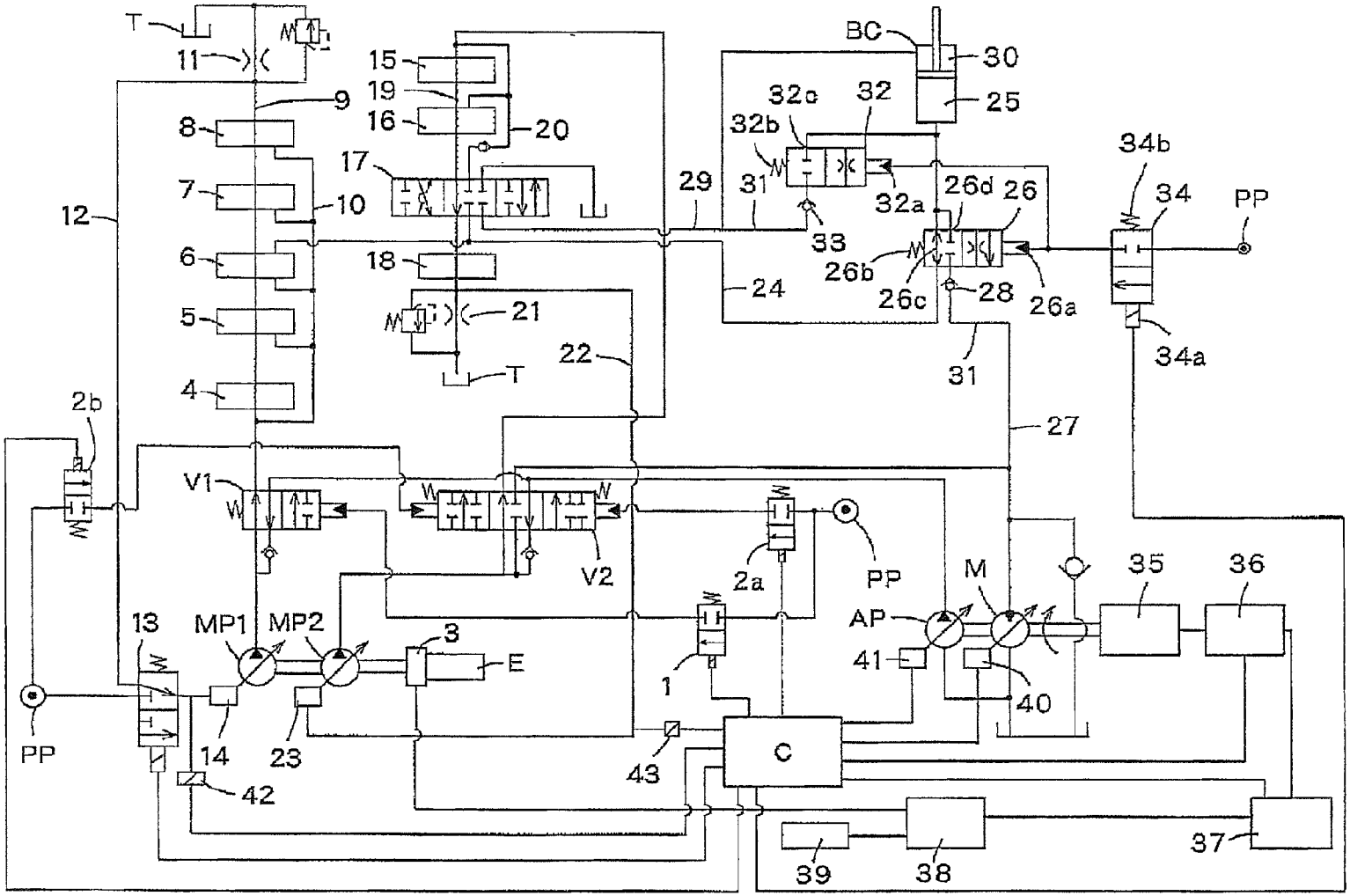
FIG. 1 is a circuit diagram of a control system for hybrid construction machine according to a first embodiment of the present invention.

The first embodiment shown in FIG. 1 includes first and second main pumps MP1, MP2 which are variable-displacement pumps. The first main pump MP1 is connected to a first circuit system via a first switching valve V1, and the second main pump MP2 is connected to a second circuit system via a second switching valve V2.

The first switching valve V1 is a 4-port 2-position switching valve, includes a pilot chamber on one side thereof, causes a spring force of a spring to act on a side facing the pilot chamber and is normally kept at a shown normal position by the action of the spring force.

When the first switching valve V1 is at the shown normal position, a supply passage and a joint passage are opened, whereby discharged oil from the first main pump MP1 is introduced to the first circuit system via the supply passage and discharged oil from an assist pump AP, which is a variable-displacement pump, joins the discharged oil from the first main pump MP1 via the joint passage and a check valve.

When a pilot pressure acts on the pilot chamber and the first switching valve V1 is switched to a switch position on the right side in FIG. 1, the joint passage is closed. Thus, only the discharged oil from the first main pump MP1 is supplied to the first circuit system.

The second switching valve V2 is a 6-port 3-position switching valve, includes pilot chambers and centering springs on both sides thereof, and is normally kept at a shown normal position by spring forces of the centering springs. At the normal position, a supply passage and a joint passage are opened similar to the first switching valve V1, and a regeneration flow path provided between these supply passage and joint passage is closed. The regeneration flow path allows discharged oil from the second main pump MP2 to flow to a variable-displacement hydraulic motor M.

If the second switching valve V2 is at the normal position, the discharged oil from the assist pump AP joins the discharged oil from the second main pump MP2 via the joint passage and a check valve and is introduced to the second circuit system.

When the second switching valve V2 is switched to a first switch position on the right side in FIG. 1, only the supply passage is opened and only the discharged oil from the second main pump MP2 is supplied to the second circuit system.

When the second switching valve V2 is switched to a second switch position on the left side in FIG. 1, all the discharged oil from the second main pump MP2 is supplied to the hydraulic motor M since only the regeneration flow path is opened.

An electromagnetic valve 1 is an electromagnetic valve for allowing the pilot chamber of the first switching valve V1 to communicate with a pilot hydraulic pressure source PP and cutting off this communication. The electromagnetic valve 1 cuts off the communication between the pilot hydraulic pressure source PP and the pilot chamber of the first switching valve V1 when being at a shown normal position and introduces a pilot pressure of the pilot hydraulic pressure source PP to the pilot chamber when being switched to a switch position by exciting a solenoid thereof.

Further, an electromagnetic valve 2*a* is an electromagnetic valve for allowing communication between one pilot chamber of the second switching valve V2 and the pilot hydraulic pressure source PP and cutting off this communication. An electromagnetic valve 2*b* is an electromagnetic valve for allowing communication between the other pilot chamber of the second switching valve V2 and the pilot hydraulic pressure source PP and cutting off this communication. The electromagnetic valves 2*a*, 2*b* cut off the communication between the pilot chamber and the pilot hydraulic pressure source PP when being at a shown normal position and allow the pilot chamber and the pilot hydraulic pressure source PP to communicate when being switched to a switch position.

Solenoids of the electromagnetic valves 1, 2*a* and 2*b* are connected to a controller C, and the controller C sets the solenoids of the electromagnetic valves 1, 2*a* and 2*b* in an excited state or in a non-excited state in accordance with a signal input by an operator.

The first and second main pumps MP1, MP2 connected to the first and second switching valves V1, V2 coaxially rotate using an engine E with a rotational speed sensor as a drive source.

A generator 3 is provided in the engine E and fulfills a power generation function utilizing remaining power of the engine E.

The first main pump MP1 is connected to the first circuit system via the first switching valve V1. To the first circuit system are connected an operation valve 4 for controlling a rotation motor, an operation valve 5 for controlling an arm cylinder, a boom second speed operation valve 6 for controlling a boom cylinder BC, an operation valve 7 for controlling an auxiliary attachment and an operation valve 8 for controlling a left travel motor in this order from an upstream side.

The respective operation valves 4 to 8 are connected to the first main pump MP1 via a neutral flow path 9, a parallel passage 10 and the first switching valve V1.

A throttle 11 for pilot pressure control for generating a pilot pressure is provided downstream of the operation valve 8 for the left travel motor in the neutral flow path 9. The throttle 11 generates a high pilot pressure at an upstream side if a flow rate through the throttle 11 is high while generating a low pilot pressure if the flow rate is low.

Further, the neutral flow path 9 introduces all or part of oil supplied from the first main pump MP1 to the first circuit system to a tank T via the throttle 11 when all the operation valves 4 to 8 are at or near a neutral position. In this case, a high pilot pressure is generated since the flow rate through the throttle 11 is high.

On the other hand, if the operation valves 4 to 8 are switched to a full-stroke state, the neutral flow path 9 is closed and a fluid does not flow any longer. Accordingly, the flow rate through the throttle 11 becomes zero, wherefore the pilot pressure is kept at zero.

Depending on the operating amounts of the operation valves 4 to 8, part of the pump-discharged oil is introduced to actuators and part thereof is introduced to the tank T from the neutral flow path 9. Thus, the throttle 11 generates a pilot pressure corresponding to the flow rate in the neutral flow path 9. In other words, the throttle 11 generates the pilot pressure corresponding to the operating amounts of the operation valves 4 to 8.

Further, a pilot flow path 12 is connected between the operation valve 8 and the throttle 11 in the neutral flow path 9. The pilot flow path 12 is connected to a regulator 14 for controlling a tilting angle of the first main pump MP1 via an electromagnetic switching valve 13.

The regulator 14 controls the tilting angle of the first main pump MP1 in inverse proportion to a pilot pressure in the pilot flow path 12 to control a displacement volume per rotation of the first main pump MP1. If there is no more flow in the neutral flow path 9 and the pilot pressure is zeroed by setting the operation valves 4 to 8 in the full-stroke state, the tilting angle of the first main pump MP1 is maximized to maximize the displacement volume per rotation of the first main pump MP1.

Further, the electromagnetic switching valve 13 is connected to the pilot hydraulic pressure source PP. The regulator 14 communicates with the pilot flow path 12 when the electromagnetic switching valve 13 is at a normal control position which is a shown normal position. When the electromagnetic switching valve 13 is switched to a switch position by exciting a solenoid thereof, the regulator 14 communicates with the pilot hydraulic pressure source PP. The solenoid of the electromagnetic switching valve 13 is connected to the controller C, and the controller C switches the electromagnetic switching valve 13 to the switch position by exciting the solenoid of the electromagnetic switching valve 13 when a signal is input from the operator and keeps the electromagnetic switching valve 13 at the normal control position by setting the solenoid in a non-excited state unless a signal is input.

The electromagnetic switching valve 13 makes the discharge amount of the first main pump MP1 less than in a normal neutral state when all the operation valves 4 to 8 are kept at the neutral position. For example, the electromagnetic switching valve 13 is switched such as during a warm-up operation in which it is desirable to reduce loss.

On the other hand, the second main pump MP2 is connected to the second circuit system. To the second circuit system are connected an operation valve 15 for controlling a right travel motor, an operation valve 16 for controlling a bucket cylinder, an operation valve 17 for controlling the boom cylinder BC, and an operation valve 18 for arm second speed for controlling the arm cylinder in this order from an upstream side.

The respective operation valves 15 to 18 are connected to the second main pump MP2 via a neutral flow path 19 and the second switching valve V2. The operation valves 16, 17 are connected to the second main pump MP2 via a parallel passage 20 and the second switching valve V2.

A throttle 21 for pilot pressure control is provided downstream of the operation valve 18 in the neutral flow path 19. The throttle 21 functions in just the same manner as the throttle 11 of the first circuit system.

A pilot flow path 22 is connected between the most downstream operation valve 18 and the throttle 21 in the neutral flow path 19. The pilot flow path 22 is connected to a regulator 23 for controlling a tilting angle of the second main pump MP2.

The regulator 23 controls the tilting angle of the second main pump MP2 in inverse proportion to a pilot pressure in the pilot flow path 22 to control a displacement volume per rotation of the second main pump MP2. If there is no more flow in the neutral flow path 19 and the pilot pressure is zeroed by setting the operation valves 15 to 18 in the full-stroke state, the tilting angle of the second main pump MP2 is maximized to maximize the displacement volume per rotation of the second main pump MP2.

One actuator port of the operation valve 17 that controls the boom cylinder BC communicates with a piston-side chamber 25 via one passage 24. A regeneration flow control valve 26 constituting a valve mechanism is provided at the communicating passage 24. The regeneration flow control valve 26 includes a pilot chamber 26*a* on one side thereof and a spring 26*b* on a side thereof facing the pilot chamber 26*a*.

The regeneration flow control valve 26 is kept at a shown normal position by a spring force of the spring 26*b*, but is switched to a switch position on the right side in FIG. 1 when a pilot pressure acts on the pilot chamber 26*a*.

When the regeneration flow control valve 26 is at the shown normal position, a main flow path 26*c* for allowing communication between the one actuator port of the operation valve 17 and the piston-side chamber 25 is fully opened and a regeneration flow path 26*d* for allowing communication between the piston-side chamber 25 and the hydraulic motor M is closed.

A passage 27 allows communication between the regeneration flow path 26*d* and the hydraulic motor M, and a check valve 28 for permitting only the flow from the regeneration flow path 26*d* to the hydraulic motor M is provided at the passage 27.

Another actuator port of the operation valve 17 that controls the boom cylinder BC communicates with a rod-side chamber 30 of the boom cylinder BC via another passage 29. Further, the other passage 29 and the piston-side chamber 25 are connected via a recovery passage 31. A recovery flow control valve 32 constituting the valve mechanism is provided in the recovery flow path 31. The recovery flow control valve 32 includes a pilot chamber 32*a* on one side thereof and a spring 32*b* on a side thereof facing the pilot chamber 32*a*.

The recovery flow control valve 32 is kept at a shown normal position by a spring force of the spring 32*b*, closes a recovery flow path 32*c* at the normal position and, on the other hand, is switched to a switch position on the right side in FIG. 1 and maintains the recovery flow path 32*c* at a throttle opening corresponding to a switched amount when a pilot pressure acts on the pilot chamber 32*a*.

A check valve 33 is provided in the recovery flow path 31 and permits only the flow from the piston-side chamber 25 to the other passage 29.

The respective pilot chambers 26*a*, 32*a* of the regeneration flow control valve 26 and the recovery flow control valve 32 are connected to the pilot hydraulic pressure source PP via a proportional electromagnetic valve 34. The proportional electromagnetic valve 34 includes a solenoid 34*a* connected to the controller C on one side thereof and a spring 34*b* on a side opposite to the solenoid 34*a*.

The proportional electromagnetic valve 34 is kept at a shown normal position by a spring force of the spring 34*b*. When the controller C excites the solenoid 34*a* in accordance with an input signal from the operator, the proportional electromagnetic valve 34 is switched and the opening is controlled according to an excitation current.

Accordingly, pilot pressures acting on the pilot chambers 26*a*, 32*a* of the regeneration flow control valve 26 and the recovery flow control valve 32 can be controlled by the controller C.

However, the spring force of the spring 32*b* of the recovery flow control valve 32 is set to be larger than that of the spring 26*b* of the regeneration flow control valve 26, so that the recovery flow control valve 32 is set to be opened at a later timing even if the same pilot pressure acts.

Further, the hydraulic motor M communicating with the regeneration flow path 26*d* of the regeneration flow control valve 26 coaxially rotates with the assist pump AP and is linked with an electric-motor-generator 35. The electric-motor-generator 35 fulfills a power generation function by the rotation of the hydraulic motor M, and power generated by the electric-motor-generator 35 is charged into a battery 37 via an inverter 36. The battery 37 is connected to the controller C and the charged amount of the battery 37 can be recognized by the controller C.

A battery charger 38 charges power generated by the generator 3 into the battery 37. In this embodiment, the battery charger 38 is also connected to a power supply 39 of another system such as a household power supply.

Further, a tilting angle of the hydraulic motor M is controlled by a regulator 40. The regulator 40 is connected to the controller C and the tilting angle is controlled in accordance with a signal from the controller C.

The assist pump AP is a variable-displacement pump and a tilting angle thereof is controlled by a regulator 41. The regulator 41 is connected to the controller C.

Accordingly, when the hydraulic motor M rotates the electric-motor-generator 35, the tilting angle of the assist pump AP is minimized to set a state where a load thereof hardly acts on the hydraulic motor M. Further, when the electric-motor-generator 35 functions as an electric motor, the assist pump AP is rotated by a drive force of the electric-motor-generator 35 to fulfill a pump function.

In this embodiment, if the first and second main pumps MP1, MP2 are caused to discharge oil with the electromagnetic valves 1, 2*a* and 2*b* set in the non-excited state and the first and second switching valves V1, V2 kept at the shown normal position, the discharged oil is supplied to the first and second circuit systems.

If the assist pump AP is caused to discharge hydraulic oil, the discharged oil joins the discharged oil from the first and second main pumps MP1, MP2 and is supplied to the first and second circuit systems.

To rotate the assist pump AP, the electric-motor-generator 35 is rotated as the electric motor by power stored in the battery 37 and a rotational force thereof can be used as a drive source of the assist pump AP. In this case, output loss of the electric-motor-generator 35 that functions as the electric motor is minimized by minimizing the tilting angle of the hydraulic motor M and reducing its load.

Further, the assist pump AP can also be rotated by the rotational force of the hydraulic motor M. A case where the hydraulic motor M is used as the drive source is described later.

Pressure sensors 42, 43 for detecting pressures introduced to the regulators 14, 23 for the first and second main pumps MP1, MP2 are provided and pressure signals thereof are input to the controller C. The controller C maintains the tilting angle of the assist pump AP at an angle set in advance in accordance with the pressure signals of the pressure sensors 42, 43. This angle is set to obtain a most efficient assist output in accordance with the pressure signals.

Further, if the first switching valve V1 is switched to the switch position on the right side in FIG. 1 and the second switching valve V2 is switched to the first switch position on the right side in FIG. 1, only the discharged oil from the first and second main pumps MP1, MP2 is supplied to the first and second circuit systems.

Furthermore, if the second switching valve V2 is switched to the second switch position on the left side in FIG. 1, the discharged oil from the second main pump MP2 is supplied to the hydraulic motor M. When the actuator connected to the second circuit system is not operating, the hydraulic motor M can be rotated and the electric-motor-generator 35 can be caused to fulfill the power generation function by the operator switching the second switching valve V2 to the second switch position. Power generated by the electric-motor-generator 35 is charged into the battery 37 via the inverter 36.

When the electric-motor-generator 35 is rotated by the hydraulic motor M, power generation efficiency can be increased by keeping the tilting angle of the assist pump AP at a minimum level.

Further, the controller C has a function of detecting the charged amount of the battery 37 and controlling the rotational speed of the hydraulic motor M according to the charged amount.

On the other hand, the hydraulic motor M can also be rotated by return oil discharged from the piston-side chamber 25 at the time of lowering the boom cylinder BC. That is, the controller C determines whether the boom cylinder BC is to be raised or lowered according to an operating direction of an operation lever used to operate the boom cylinder BC. In the case of lowering the boom cylinder BC, the controller C controls the excitation current of the solenoid 34*a* of the proportional electromagnetic valve 34 according to the operating amount of the operation lever, i.e. a lowering speed of the boom cylinder BC intended by the operator. Accordingly, the opening of the proportional electromagnetic valve 34 increases as the lowering speed intended by the operator increases.

When the proportional electromagnetic valve 34 is opened, the pilot pressure from the pilot hydraulic pressure source PP is introduced to the pilot chamber 26*a* of the regeneration flow control valve 26 and the pilot chamber 32*a* of the recovery flow control valve 32.

However, since the spring force of the spring 26*b* of the regeneration flow control valve 26 is lower than that of the spring 32*b* of the recovery flow control valve 32, the regeneration flow control valve 26 is switched to the switch position earlier. The regeneration flow control valve 26 is switched by an amount proportional to the pilot pressure.

If the regeneration flow control valve 26 is switched to the switch position, the return oil from the piston-side chamber 25 of the boom cylinder BC is distributed into the flow returning to the one passage 24 and the flow to be supplied to the hydraulic motor M according to the switched amount of the regeneration flow control valve 26.

To maintain the lowering speed of the boom cylinder BC at a target value, the controller C controls loads of the motor M and the assist pump AP by controlling the tilting angles of the hydraulic motor M and the assist pump AP.

Since the opening of the proportional electromagnetic valve 34 increases as the lowering speed intended by the operator increases, pilot pressures acting on the pilot chambers 26*a*, 32*a* also increase. If the pilot pressure increases, the recovery flow control valve 32 is switched to the switch position and the recovery flow path 32*c* is opened by an amount proportional to the pilot pressure.

If the recovery flow path 32*c* is opened, part of the return oil from the piston-side chamber 25 of the boom cylinder BC is supplied to the rod-side chamber 30 of the boom cylinder BC via the recovery flow path 31 and the other passage 29.

The return oil from the piston-side chamber 25 is recycled to the rod-side chamber 30 when the lowering speed of the boom cylinder BC increases. This prevents the rod-side chamber 30 from having negative pressure producing abnormal noise.

An opening timing and the opening of the recovery flow control valve 32 are determined by the opening of the proportional electromagnetic valve 34, the spring force of the spring 32*b* and the like and set in advance based on characteristics required for the boom cylinder BC.

Further, it is also possible to assist the rotational force of the assist pump AP by the rotational force of the hydraulic motor M. A pressure flowing into the hydraulic motor M is thought to be lower than a discharge pressure of the second main pump MP2. In this embodiment, a boost function is fulfilled by the hydraulic motor M and the assist pump AP to maintain the high discharge pressure of the assist pump AP even if the pressure is low.

That is, an output of the hydraulic motor M is determined by a product of a displacement volume Q1 per rotation and a pressure P1 at that time. Further, an output of the assist pump AP is determined by a product of a displacement volume Q2 per rotation and a discharge pressure P2. Since the hydraulic motor M and the assist pump AP coaxially rotate in this embodiment, Q1×P1=Q2×P2 holds. For example, if the displacement volume Q1 of the hydraulic motor M is set to be three times as much as the displacement volume Q2 of the assist pump AP, i.e. Q1=3Q2, the above equation is 3Q2×P1=Q2×P2. If the both sides of this equation are divided by Q2, 3P1=P2 holds.

Accordingly, if the displacement volume Q2 is controlled by changing the tilting angle of the assist pump AP, the assist pump AP can be maintained at a predetermined discharge pressure by the output of the hydraulic motor M. In other words, oil can be discharged from the assist pump AP after boosting the hydraulic pressure from the boom cylinder BC.

A second embodiment is described.

Figure 2:
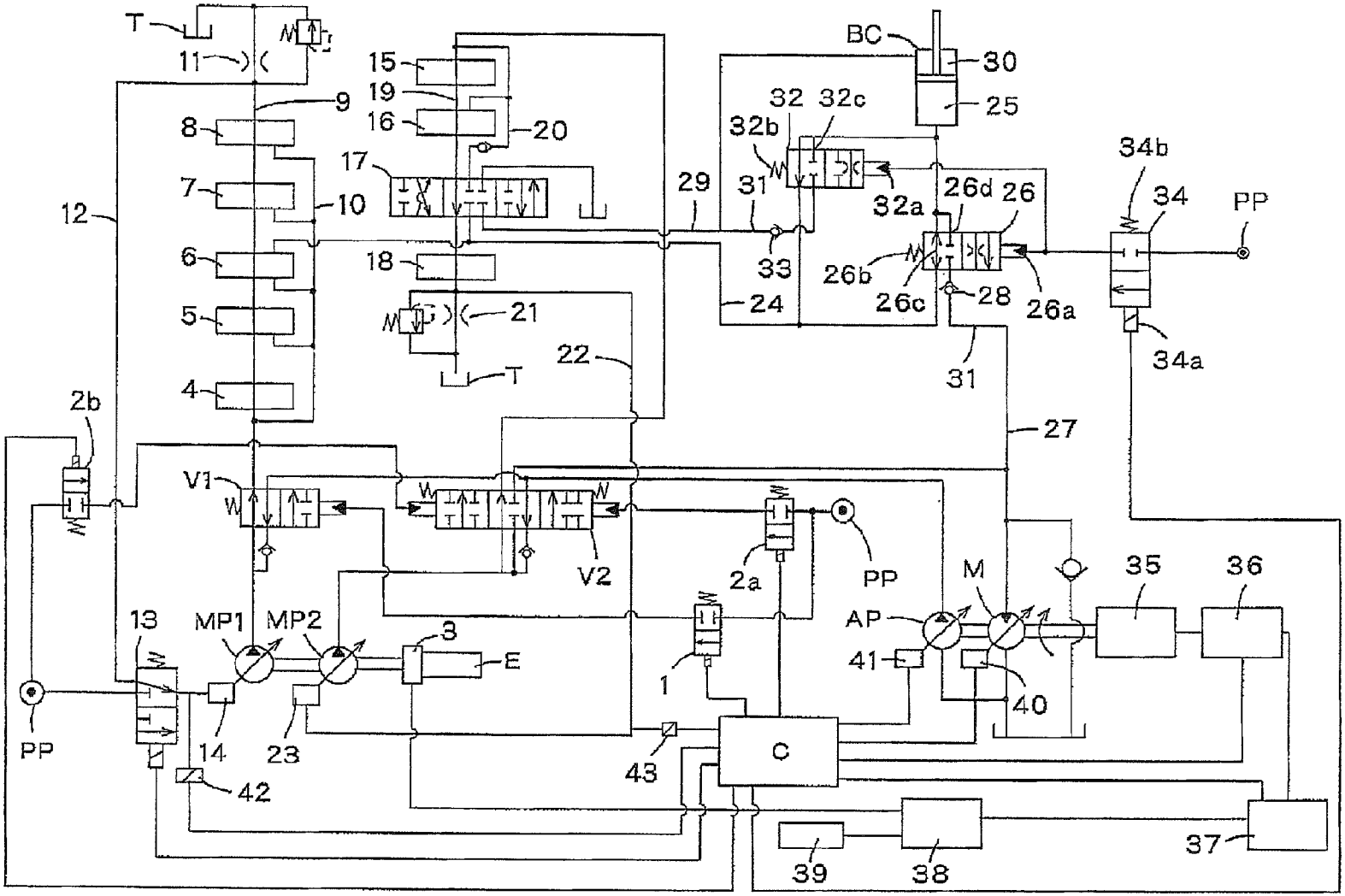
FIG. 2 is a circuit diagram of a control system for hybrid construction machine according to a second embodiment of the present invention.

In the second embodiment shown in FIG. 2, a regeneration flow control valve 26 and a recovery flow control valve 32 are 2-position 4-port valves. Actually, only the recovery flow control valve 32 differs from the first embodiment. Although the recovery flow control valve 32 in the first embodiment is the 2-position 2-port valve, the recovery flow control valve 32 of this embodiment is a 2-position 4-port valve. The function of the recovery flow control valve 32 of this embodiment is the same as the recovery flow control valve of the first embodiment. That is, the recovery flow control valve 32 closes a recovery flow path 32*c* at a normal position and opens the recovery flow path 32*c* at a switch position.

The 2-position 4-port valve is used as the recovery flow control valve 32 in the second embodiment because there is a merit of being able to commonly use valve bodies if the regeneration flow control valve 26 and the recovery flow control valve 32 have the same number of ports.

A third embodiment is described.

Figure 3:
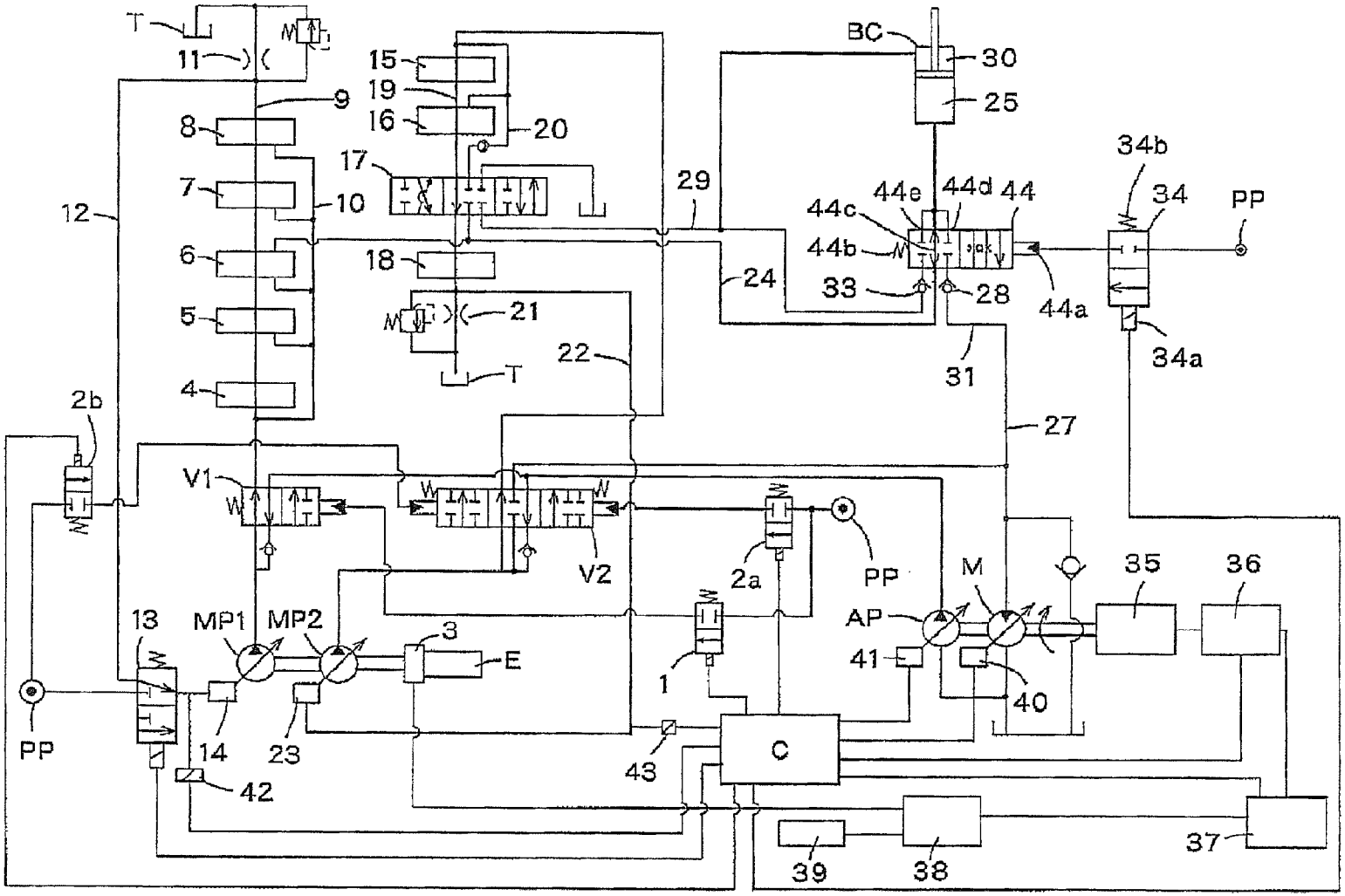
FIG. 3 is a circuit diagram of a control system for hybrid construction machine according to a third embodiment of the present invention.

The third embodiment shown in FIG. 3 differs from the first and second embodiments in the following points. Although the valve mechanism is composed of two valves, i.e. the regeneration flow control valve 26 and the recovery flow control valve 32 in the first and second embodiments, these valves are replaced by one integrated valve 44 in this embodiment.

The integrated valve 44 is 2-position 6-port valve and includes a pilot chamber 44*a* connected to a pilot hydraulic pressure source PP via the same proportional electromagnetic valve 34 as in the first embodiment on one side and a spring 44*b* on a side facing the pilot chamber 44*a*. Further, the integrated valve 44 is provided with a main flow path 44*c*, a regeneration flow path 44*d* and a recovery flow path 44*e*, and only the main flow path 44*c* is maintained in a fully open state when the integrated valve 44 is at a shown normal position.

Further, the regeneration flow path 44*d* and the recovery flow path 44*e* are switched at the switch position of the integrated valve 44 and opened at different timings according to a movement amount of a spool.

Since points other than the above ones are exactly the same as in the first and second embodiments, they are not described in detail.

Although the embodiments of the present invention have been described above, the above embodiments are merely illustrations of some application examples of the present invention and not of the nature to limit the technical scope of the present invention to the specific constructions of the above embodiments.

The present application claims a priority based on Japanese Patent Application No. 2010-42233 filed with the Japan Patent Office on Feb. 26, 2010, all the contents of which are hereby incorporated by reference.

INDUSTRIAL APPLICABILITY

The present invention can be used for construction machines such as power shovels.

The invention claimed is:

1. A control system for construction machine, comprising:

a main pump;

a circuit system which includes a plurality of operation valves connected to the main pump;

a boom cylinder which includes a piston-side chamber and a rod-side chamber, and which is connected to a specific one of the plurality of operation valves;

one passage which allows communication between the specific operation valve and the piston-side chamber of the boom cylinder;

another passage which allows communication between the specific operation valve and the rod-side chamber of the boom cylinder;

a hydraulic motor which rotates by the action of return oil from the piston-side chamber of the boom cylinder;

a generator which generates power by a rotational force of the hydraulic motor;

a battery which stores power generated by the generator; and a valve mechanism which introduces the return oil directly from the piston-side chamber of the boom cylinder through the one passage at the time of descent as a regeneration flow to the hydraulic motor, and introduces the return oil as a recovery flow to the rod-side chamber of the boom cylinder, if necessary, through the other passage.

2. The control system according to claim 1, wherein:

the valve mechanism has a control function of controlling a supply flow rate to the hydraulic motor according to an operating amount of the specific operation valve at the time of a control to lower the boom cylinder by operating the specific operation valve.

3. The control system according to claim 1, wherein:

the valve mechanism supplies return oil from the boom cylinder as a recovery flow to the rod-side chamber of the boom cylinder when a lowering speed command of the boom cylinder is equal to or higher than a set speed at the time of a control to lower the boom cylinder by operating the specific operation valve.

4. The control system according to claim 1, wherein:

the valve mechanism connects a pilot pressure source to a pilot chamber via a proportional electromagnetic valve and causes an opening of the proportional electromagnetic valve to be controlled by a controller by causing a spring force of a spring to act on a side facing the pilot chamber.

5. The control system according to claim 1, wherein the valve mechanism includes:

a regeneration flow control valve switchable between a first normal position where the one passage is opened while the communication with the hydraulic motor is cut off and a first switched position where the communication with the hydraulic motor is opened while the one passage is throttle controlled; and a recovery flow control valve which is provided at a recovery passage which allows the piston-side chamber and the rod-side chamber of the boom cylinder to communicate, kept in a closed state at a second normal position and kept in an open state at a second switched position.

6. The control system according to claim 1, wherein the valve mechanism is disposed in the one passage between the piston-side chamber of the boom cylinder and the specific operation valve.

7. The control system according to claim 1, wherein the valve mechanism include a pilot chamber and a spring, said pilot chamber being connected to a pilot pressure source, said spring providing a spring force on a side opposite to said pilot chamber, and a switching timing of a position of a valve included in the valve mechanism is changed depending on an amount of the spring force of the spring.

8. The control system according to claim 7, wherein an opening of said valve included in the valve mechanism is controlled by a pilot pressure of the pilot chamber included in the valve mechanism.

9. The control system according to claim 7, further comprising:

a proportional electromagnetic valve through which said pilot chamber included in the valve mechanism connects the pilot pressure source, and a controller which controls an opening of the proportional electromagnetic valve, wherein a pilot pressure of the pilot chamber included in the valve mechanism is controlled by said controller through said proportional electromagnetic valve.

10. The control system according to claim 9, wherein the regeneration flow control valve switches the position from said first normal position to said first switched position before the recovery flow control valve switches the position from the second normal position to said second switched position.

11. The control system according to claim 9, wherein the regeneration flow control valve include a first pilot chamber and a first spring which provides a first spring force on a side opposite to said first pilot chamber, the recovery flow control valve include a second pilot chamber and a second spring which provides a second spring force on a side opposite to said second pilot chamber, and said first spring force of the first spring is smaller than said second spring force of the second spring.

12. The control system according to claim 1, wherein the valve mechanism includes:

a regeneration flow control valve adapted to be switched between a first normal position and a first switched position wherein, in the first normal position, the regeneration flow control valve opens the one passage while closing a motor passage which is connected to the hydraulic motor and in the first switched position, the regeneration flow control valve controls an amount of flow passing through the one passage while allowing the return oil to flow to the hydraulic motor through the motor passage; and a recovery flow control valve adapted to be switched between a second normal position and a second switched position, wherein in the second normal position, the recovery flow control valve closes a recovery passage, and in the second switched position, the recovery flow control valve controls an amount of a flow of the recovery passage and allows said recovery passage to flow the return oil from the piston-side chamber to the rod-side chamber of the boom cylinder.

13. The control system according to claim 12, wherein in the first switched position, the regeneration flow control valve controls an amount of each flow of the one passage and the motor passage which is connected to the hydraulic motor depending on a lowering speed of the boom cylinder.

14. The control system according to claim 12, wherein said recovery passage connects the piston-side chamber of the boom cylinder to the other passage.

15. A control system for construction machine, comprising:

a main pump;

a circuit system which includes a plurality of operation valves connected to the main pump;

a boom cylinder which includes a piston-side chamber and a rod-side chamber, and which is connected to a specific one of the plurality of operation valves;

one passage which allows communication between the specific operation valve and the piston-side chamber of the boom cylinder;

another passage which allows communication between the specific operation valve and the rod-side chamber of the boom cylinder;

a hydraulic motor which rotates by the action of return oil from the piston-side chamber of the boom cylinder;

a generator which generates power by a rotational force of the hydraulic motor;

a battery which stores power generated by the generator; and a valve mechanism which receives the return oil from the piston-side chamber of the boom cylinder through the one passage without passing through any other valves at the time of descent as a regeneration flow and provides said return oil to the hydraulic motor, and introduces said return oil as a recovery flow to the rod-side chamber of the boom cylinder, if necessary, through the other passage.

16. The control system according to claim 15, wherein the valve mechanism is disposed in the one passage between the piston-side chamber of the boom cylinder and the specific operation valve.

* * * * *